United States Patent [19]

Engel

[11] Patent Number: 4,735,356

[45] Date of Patent: Apr. 5, 1988

[54] KNOCKDOWN MAILER AND ADVERTISING DEVICE IN A PERIODICAL

[76] Inventor: Peter Engel, West La., Revonah Woods, Stamford, Conn. 06905

[21] Appl. No.: 851,228

[22] Filed: Apr. 14, 1986

[51] Int. Cl.[4] ..... B65D 5/08

[52] U.S. Cl. ..... 229/103; 206/459; 229/92.8; 229/122; 229/138; 229/153; 229/921

[58] Field of Search ..... 229/138, 142, 70, 71, 229/92.8, 103, 8.5, 907, 122, 153, 152, 921; 206/232, 459, 467, 469, 806

[56] References Cited

U.S. PATENT DOCUMENTS

| | | | |
|---|---|---|---|
| 432,885 | 7/1890 | Lohmann | 229/122 |
| 1,091,333 | 3/1914 | Heidel | 229/8.5 |
| 1,987,081 | 1/1935 | Scott | 206/459 |
| 2,022,906 | 12/1935 | Weeks | 206/459 |
| 2,038,219 | 4/1936 | Holy | 229/138 |
| 2,250,995 | 7/1941 | Lansky | 229/8.5 |
| 2,301,618 | 11/1942 | Curtis | 229/921 |
| 2,481,288 | 9/1949 | Cage | 229/142 |
| 3,147,856 | 9/1964 | Lightner et al. | 206/232 |
| 3,494,536 | 2/1970 | Henry | 229/907 |
| 3,521,812 | 7/1970 | Moers et al. | 229/138 |
| 4,121,755 | 10/1978 | Meseke et al. | 229/907 |
| 4,291,807 | 9/1981 | Giordano et al. | 229/152 |
| 4,360,106 | 11/1982 | Irvine et al. | 229/153 |

FOREIGN PATENT DOCUMENTS

| | | | |
|---|---|---|---|
| 1132786 | 11/1956 | France | 229/92.8 |
| 1480373 | 4/1967 | France | 206/806 |
| 20629 | of 1899 | United Kingdom | 229/92.8 |
| 1005452 | 9/1965 | United Kingdom | 206/232 |

*Primary Examiner*—Stephen Marcus
*Assistant Examiner*—Gary E. Elkins
*Attorney, Agent, or Firm*—Arthur T. Fattibene

[57] ABSTRACT

A packaging and advertising device comprising a blank of readily foldable material having a transverse frangible tear line for dividing the blank into a header portion and a connected foldable box forming portion. The box forming portion is reversely folded upon itself in the knockdown position whereby the header portion and connected reversely folded box portion define an essentially flat insert which can be readily inserted between the pages of a periodical.

The box forming portion is further prescored and/or die cut so that the same can be readily formed into a sealable box which can be readily separated from its header portion and used as a mailer or package for mailing various articles.

1 Claim, 4 Drawing Sheets

KNOCKDOWN MAILER AND ADVERTISING DEVICE IN A PERIODICAL

FIELD OF INVENTION

This invention relates to a packaging and advertising device which can be readily formed of foldable blank sheet material which includes a header portion and readily separable knock-down box portion adapted to be readily inserted between the pages of a periodical, e.g. a newspaper, magazine and the like, for advertising a given product and/or for enhancing the sale of a given product; and which knock-down box portion can be readily erected to form a box suitable for mailing various articles.

PROBLEM AND PRIOR ART

In advertising and/or in enhancing the sale of a product, the maker or seller of a given product frequently engages in an advertising campaign wherein the consumer is requested to return to the manufacturer or seller of the given product some evidence of a purchase in order to receive a rebate, free goods, or other premium or prize. Heretofore, such evidence of purchase has been limited to box tops, coupons or the like which could be readily mailed in ordinary envelopes. For this reason, such types of advertising campaigns were limited to only certain products where evidence of purchase could be established by a box top or coupon and the like.

The evidence of purchase of many other products cannot be readily so evidenced, e.g. products sold in cans, bottles and/or in physical three-dimensional forms such as razors, razor blades and a host of other products. Also, in many instances, a manufacturer desired that some portion or all of such physical device be returned to evidence proof of purchase, e.g. bottle caps, worn razor blades, razors and/or the like. Thus, when such advertising campaigns required the consumer to return a physical portion of the product, which could not be readily mailed in an conventional envelope, the results were relatively poor, as many consumers found it too burdensome to box or otherwise return such three dimensional portions of a given product. For this reason, many consumers would not participate in such advertising campaigns. While there exists a host of prior known box constructions, per se, which can be erected from a knock-down position, it is not known that such known box construction, per se, have been utilized or made in the manner herein set forth so as to be used as a free standing insert between the pages of a periodical.

OBJECTS

An object of this invention is to provide a packaging and advertising device to evidence proof of purchase constructed so as to facilitate consumer response.

Another object of this invention is to provide a packaging and advertising device which can be readily circulated to the public or consumer by means of inserting the same in various periodicals or the like which are widely distributed.

Another object is to provide a packaging and advertising device which can be readily circulated or distributed to the ultimate consumer in a knock-down position, and which the consumer can readily erect and use to participate in an advertising campaign requiring the return of a physical device to evidence proof of purchase and the like.

Another object is to provide a packaging and advertising device which is readily simple in construction, inexpensive to manufacture and which is positive in operation, and which in its knock-down form can be automatically inserted into newspapers, periodicals and the like.

Another object is to provide a packaging and advertising device which, in its knock-down position, can be utilized as a circular or ad for a given product, and which invites and facilitates consumer participation in an advertising campaign which requires the consumer to return something of bulk to the advertiser.

SUMMARY OF THE INVENTION

The foregoing objects and other features and advantages are attained by a packaging and advertising device constructed from a blank of sheet foldable material to define a header portion and an integrally connected box forming portion, whereby the box forming portion is prescored and die cut so as to render the box forming portion readily erectible to form a closed box. The blank is provided with a transversely extending frangible tear line whereby the box forming portion can be readily separated therefrom. The arrangement is such that the device in its knock-down position defines an essentially flat structure whereby it can be utilized as an insert in a given periodical or magazine whereby the same can be widely circulated to potential consumers of the producted advertised thereby. The consumer, in turn, if he or she so desires, can thereafter utilize the box forming portion to participate in an associated advertising campaign which may require the consumer to return a portion or all of the advertised product for a rebate, prize or other incentive.

The particular box forming portion is prescored and die cut so that a rectangular tube is formed by simply applying slight pressure to the box forming portion to erect the same, and whereby a side wall closing flaps hingedly connected to a side wall panel and associated end wall flaps are rendered self folding by creasing the end wall flaps diagonally thereof. The other side wall panel is provided with a side wall flap having a locking tab which in the assembled position of the box secures the end closure flaps in a closed or box erected position.

FEATURES

A feature of this invention resides in the provision of a packaging and advertising device which can be readily formed from a single blank of sheet material which is constructed to be used as a free standing insert in the knock down position thereof, and which includes a box forming portion which can be readily erected into a closed box to be used as a mailer or package for a given article or articles.

Another feature resides in the provision of a packaging and advertising device having a box forming portion which is partially assembled, and which portion is prescored and die cut so that a closed box or package can be readily formed from the partially assembled box forming portion.

Other features and advantages will become more readily apparent when considered in view of the drawings and specifications in which.

DETAILED DESCRIPTION

Figure 1:
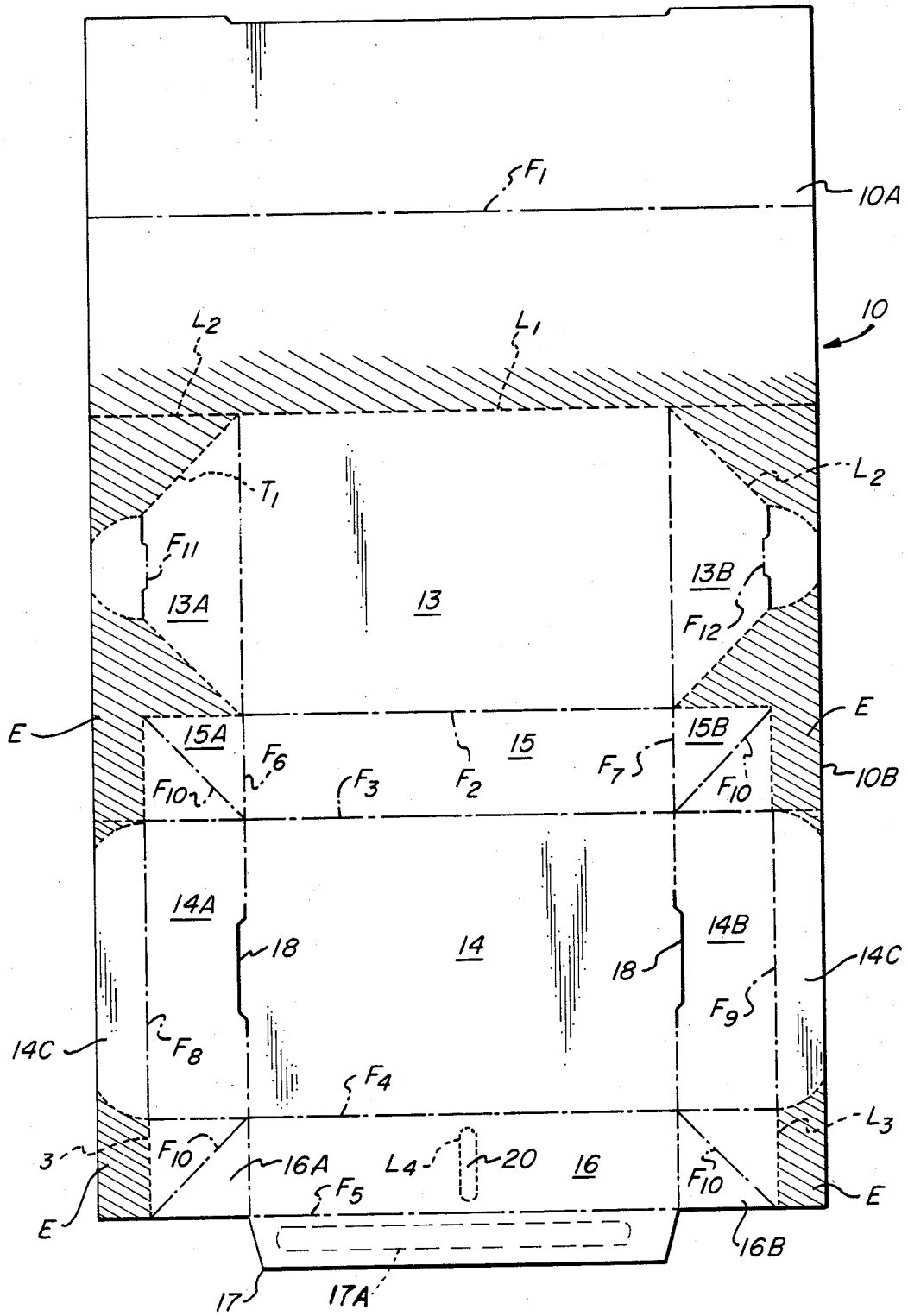
FIG. 1 is a plan view of a blank of sheet material from which the packaging and advertising device is formed, and showing the prescoring and/or die cutting thereof.
Figure 2:
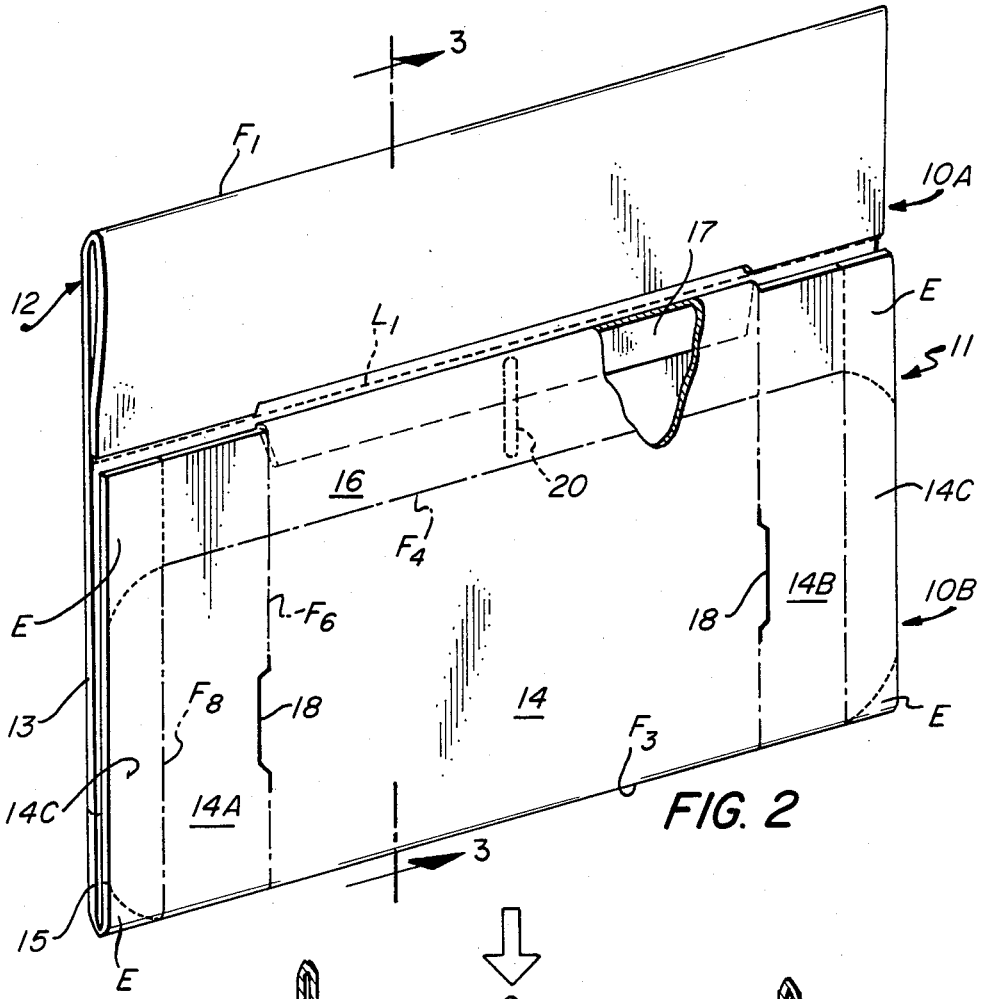
FIG. 2 is a perspective view of the blank of FIG. 1, folded to define a free standing insert.
Figure 3:
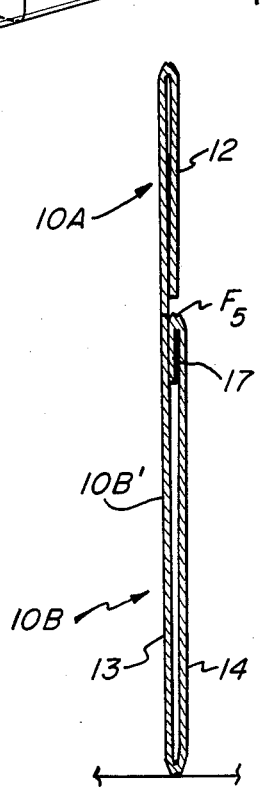
FIG. 3 is a section view taken along line 3—3 on FIG. 2.
Figure 3A:
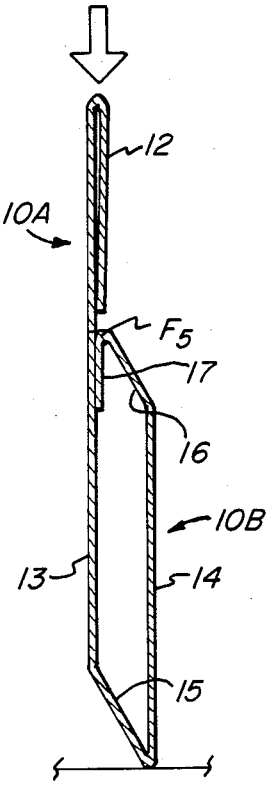
FIG. 3A is a partially erected sectional view.

Referring to the drawings, there is shown in FIG. 1 the blank 10 from which the free standing insert 11 of FIG. 2 is formed. The blank 10 comprises a readily foldable rectangular sheet of material, e.g. cardboard having a predetermined length and width. Extending transversely of the blank 10 intermediate the length thereof is a frangible tear line $L_1$. As shown, the tear line $L_1$ comprises a series of perforations or other suitable frangible means. The tear line $L_1$ thus divides the blank 10 into a header portion 10A and a box forming portion 10B. The header portion 10A may comprise either a single ply header or a double ply header as will be hereinafter described. If a double or two-ply header is desired, the header portion 10A is provided with a transversely extending foldline $F_1$, as shown in FIG. 1, about which the header portion 10A can be reversely folded to define a double or two-ply header 12 as shown in FIGS. 2 and 3. Suitable bonding means, adhesives or other suitable fastening means, such as staples, and the like, may be employed to secure the reversely folded header portion 10A in contiguous folded relationship as shown in FIG. 1. For a single ply header 12, the foldline $F_1$ may be omitted.

The box forming portion 10B, which comprises an integral extension of the header portion 10A, is prescored and/or die cut in a predetermined manner to define the side wall panels and end wall panels and associated closure end flaps to define a closed box in the erected position of the box forming portion 10B. As best seen in FIG. 1, the box forming portion 10B is provided with a plurality of spaced apart transversely extending foldines $F_2$, $F_3$, $F_4$ and $F_5$ to define contiguous and alternately disposed side wall panels and end wall panels. The side wall panels comprise panels 13 and 14 with end panel 15 disposed between side panels 13 and 14 and end panel 16 hingedly connected to side wall panel 14. Hingedly connected to end wall panel 16 about foldline $F_5$ is a marginal flap 17.

In the expanded blank as shown in FIG. 1, the respective side wall panels 13, 14 and end wall panels 15, 16 are provided at the opposed ends thereof with end closure flaps, as will be herein described. Each of the end wall panels 15 and 16 have connected to the opposed ends thereof end wall flaps 15A, 15B and 16A, 16B respectively. As shown, each of the respective end wall flaps 15A, 15B and 16A, 16B are hingedly connected to its respective end wall panel 15, 16 about a foldline $F_6$ and $F_7$, and which foldlines $F_6$ and $F_7$ extend longitudinally of the box forming portion 10B of the blank 10.

Figure 5:
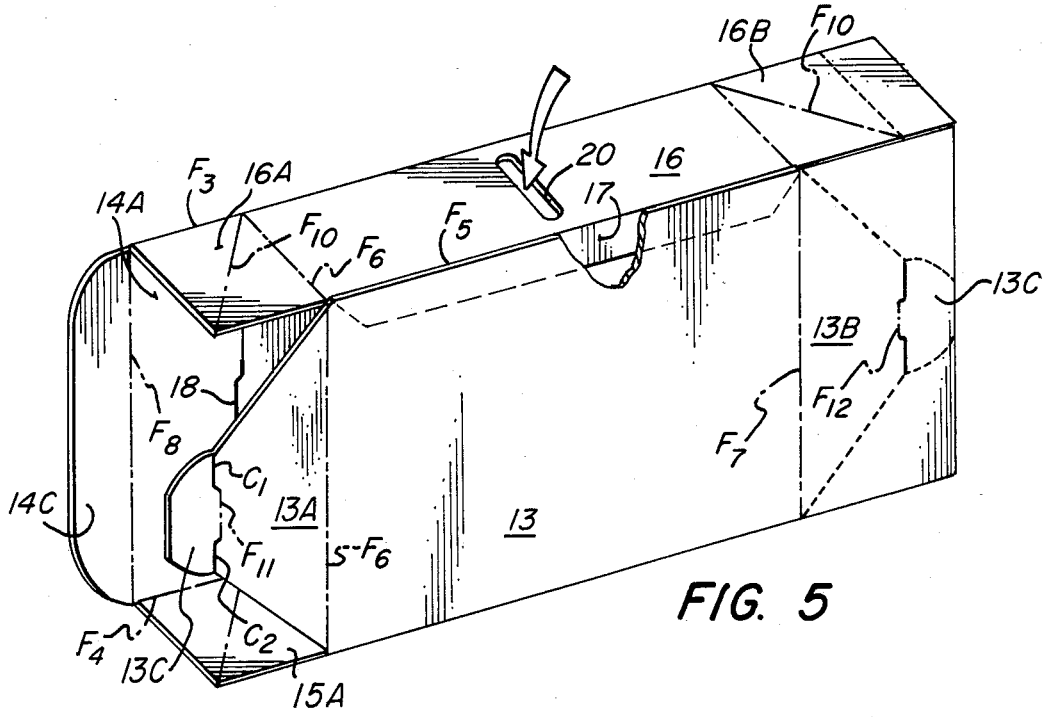
FIG. 5 shows the box forming portion in an intermediate set up position.
Figure 5A:
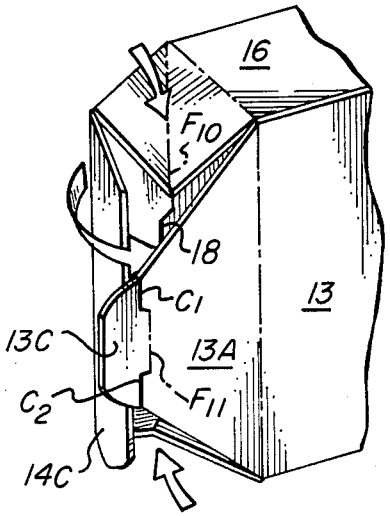
FIG. 5A is a partial perspective view illustrating a first end fold for erecting the box forming portion.

Side wall panel 14 has hingedly connected to its opposed ends a side wall panel flap 14A, 14B which are likewise arranged to fold about foldlines $F_6$ and $F_7$. Connected to each side wall flap 14A, 14B and foldable about foldlines $F_8$ and $F_9$ respectively are tongue flaps 14C—14C. As best seen in FIG. 1, the respective end wall flaps 15A, 15B and 16A, 16B are hingedly connected to its contiguous side wall end flaps 14A, 14B about foldlines $F_3$ and $F_4$. Each end wall flap 15A, 15B, and 16A and 16B are provided with a diagonal foldline $F_{10}$. The arrangement is such that in the erection of the box forming portion to a box, as will be described, the folding of the end wall flaps 15A, 15B and 16A, 16B about their respective diagonal foldline $F_{10}$ will cause the side wall flap 14A and 14B connected thereto to be automatically folded to cover the open ends of the box. See FIG. 5A.

Side wall panel 13 has connected to the opposed ends thereof, side wall end flaps 13A and 13B foldable about foldlines $F_6$ and $F_7$. The free end of side wall end flaps 13A and 13B are provided with a locking tab 13C which are adapted to fold about foldlines $F_{11}$ and $F_{12}$ respectively. disposed to each side of foldlines $F_{11}$ and $F_{12}$ are die cuts $C_1$ and $C_2$ to define a T-shaped locking tab.

Disposed intermediate the width of side wall panel 14 along the opposed foldlines $F_6$ and $F_7$ is a locking slit 18—18 which in the folded or assembled position of the box is adapted to receive the locking tabs 13C, 13C respectively.

In the illustrated embodiment, side wall end flaps 13A, 13B are shown as tapering toward the locking tab 13C. Also, in the illustrated embodiment, a means defining a frangible tear line $L_2$, $L_3$ outlines the side wall flaps 13C—13C and end wall flaps 15A, 15B, 16A, 16B to permit ready removal of the portion of the blank not required in the erection of the blank. The excess portions of the blank are designated by areas referenced by E.

The blank 10 thus described can be readily formed into a "free standing insert" by reversely folding the header portion 10A about foldline $F_1$ as shown in FIGS. 2 and 3, and securing the reversely folded portion with suitable adhesive or other fastening means. The box forming portion 10B is reversely folded about foldline $F_3$ in overlying position with the marginal flap 17 being folded about foldline $F_5$ and secured to the underlying portion $10B^1$ of the box forming portion 10B; by adhesive bond 17A, as best seen in FIG. 2. In this position, the folded blank 10 defines a readily flat insert which can be readily inserted between the pages of a periodical whereby the insert can be readily distributed to the ultimate consumer. It will be readily understood that the exposed surfaces of the blank can be preprinted with suitable indicia and/or other informative material relating to the product being advertised thereby.

Figure 4:
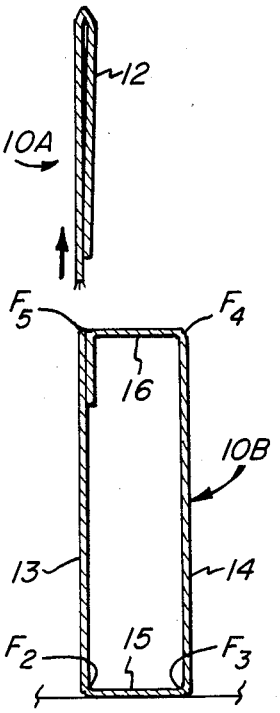
FIG. 4 shows the box forming portion in a partially erected position and separated from the header portion.
Figure 5B:
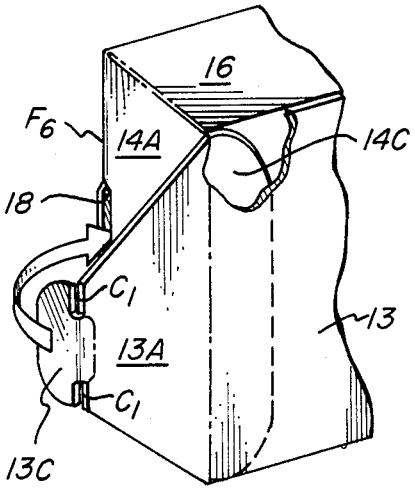
FIG. 5B is a partial perspective view illustrating a second end fold for erecting the box forming portion.
Figure 6:
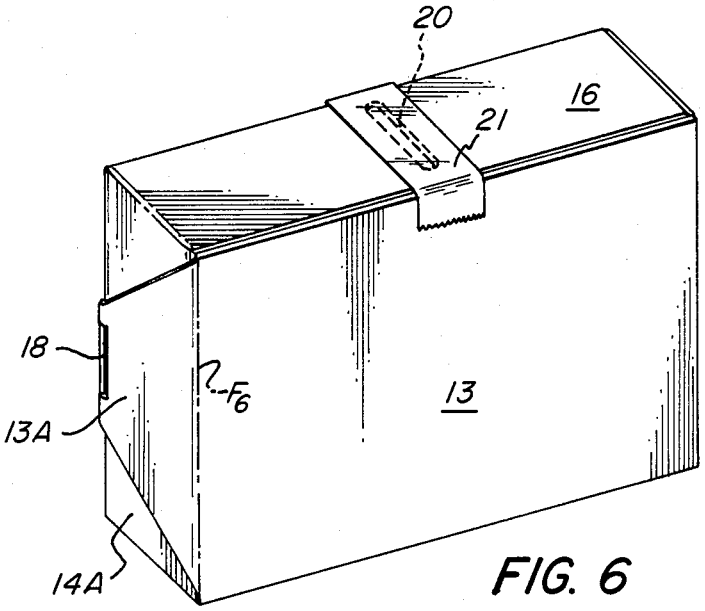
FIG. 6 shows the box forming portion in its erected position.

As the box forming portion 10B has been pre-scored and die cut as described, and as the box portion has been partially assembled as shown in FIGS. 2 and 3, the partially assembled box portion can be readily separated from the header portion along the tear line $L_1$. Thus, to assemble the partially formed box, as shown in FIG. 3, to its fully erected position as shown in FIG. 6, the box forming portion 10B is separated from its header 10A along line $L_1$. The excess portions E of the blank are then removed along the provided tear line $L_2$ and $L_3$. The partially constructed box portion 10B is then squared as shown in FIG. 4 to define a generally open ended tubular configuration. With the box forming portion squared as shown in FIG. 4, the respective end wall flaps 15A, 15B and 16A, 16B are creased along their respective diagonal foldlines $F_{10}$ inwardly causing the associated side wall flaps 14A, 14B to fold over the open ends of the box. In doing so, the tongue flap 14C is folded over to be inserted between the end flaps and the opposing side wall to close the end of the box. See FIGS. 5A and 5B. The side wall flap 13A, 13B are then folded onto the closed side wall flap 14A, 14B respectively and secured in the folded position by inserting the locking tab 13C into its respective lock slit 18. In the assembled position as shown in FIG. 6, the box is secuted by the interengagement of the lock tab 13C in its respective lock slit 18. A sealing tape (not shown) may also be used to insure the securing of the end flaps in the assembled position of the box.

If desired, the box may be provided with an opening 20 which may be formed in one of the end or side wall panels. The opening 20 may be defined by an easy tear line $L_4$. Thus, if the product is to be returned to evidence proof of sale is a bottle cap, used razor blade or other tangible article, it can be readily inserted into the sealed box through opening 20. The opening 20 can then be sealed by taping over the opening 20 by an adhesive tape 21 or the like.

From the foregoing, it will be apparent that a packaging and advertising device is provided whereby the described device can be widely distributed to a large number of consumers by inserting the device in its flattened position in the pages of any widely distributed publication, e.g. a newspaper or magazine. The arrangement is such that the consumer can then readily participate in an advertising campaign which requires the consumer to mail back to the advertiser proof of purchase which may require the shipping of tangible, three-dimensional, hard to ship items or articles.

It will be further understood that the exposed surfaces of the box, in either the knock-down or assembled form, may be provided with suitable indicia and/or copy directed to paticular product it is intended to promote. Also, in its knock-down state, the arrangement is such that it can be handled as an insert whereby it can be readily inserted into a newspaper or periodical by conventional automatic inserting machinery currently in use for the placing of inserts into such newspapers and periodicals.

While the invention has been described with respect to a particular embodiment, it will be understood and appreciated that variations and modifications can be made without departing from the spirit or scope of the described invention.

What is claimed is:

1. In combination with a periodical having a plurality of pages, a knock down mailer and advertising device distributed by the insertion thereof between the pages of the periodical in the knock down position thereof, comprising a blank of readily foldable sheet material, means forming a frangible tear line extending transversely of said blank intermediate the ends thereof to define a header portion and a box forming portion, whereby one end of said box forming portion is detachably connected to said header portion along said frangible tear line, a marginal flap hingedly connected to the other end of said box forming portion and being reversely folded relative thereof, a transversely extending foldline disposed intermediate the length of said box forming portion about which said box forming portion is reversely folded onto itself to define superposed portions so that said marginal flap is disposed adjacent said frangible tear line and between said superposed portions, means for securing said marginal flap to said one end of said box forming portion contiguous to said frangible tear line, whereby said marginal flap is disposed between said superposed portions, a fold line extending transversely of each of said superposed portions to define a contiguously connected side wall panel and an end wall panel, said box forming portion including a pair of spaced apart longitudinally extending fold lines, said transversely extending fold lines and longitudinally extending fold lines defining the perimeter of said side wall panels and end wall panels respectively, side wall end flaps connected to the opposed ends of each of said side wall panels, each of said side wall end flaps being foldable relative to its respective side wall panel about said longitudinally extending fold line, end wall panel flaps connected to the opposed ends of each of said end wall panels, said end wall flaps being hingedly connected to their corresponding end wall panels and to one only of said side wall end flaps, said end wall flaps each having a diagonal foldline extending thereacross, a tongue flap connected to each of the side wall end flaps of one of said side wall panels, and a locking end tab connected to each end of the side wall end flaps of the other side wall end panel, and a complementary locking slit formed adjacent the respective longitudinally extending foldline intermediate the width of said one side wall panel, said side and end wall panels being folded about their respective transverse foldlines to define an open tubular configuration, and said end wall flaps being adapted to fold along their respective diagonal foldlines to cause the connected side wall end flaps to overlie said end wall flaps in the folded position of said box forming portion, and said locking tab being hingedly connected to said other side wall end flap to fold in overlying relationship to the side wall end flaps of said one side wall panel in the folded position of said box forming portion, and said locking tab being secured in said locking slit in the folded position of said box forming portion, access means defining an opening in one of said end panels to provide access into the interior of said box forming portion in the folded position thereof, and means for releasably sealing said access means.

* * * * *